US011409216B2

(12) United States Patent
Borenstain et al.

(10) Patent No.: US 11,409,216 B2
(45) Date of Patent: Aug. 9, 2022

(54) HUE BASED COLOR CALIBRATION

(71) Applicant: Hewlett-Packard Development Company, L.P., Spring, TX (US)

(72) Inventors: Shmuel Borenstain, Ness Ziona (IL); Gil Bar-Haim, Ness Ziona (IL); Keren Goldshtein, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,445

(22) PCT Filed: Feb. 25, 2019

(86) PCT No.: PCT/US2019/019375

§ 371 (c)(1),
(2) Date: Dec. 28, 2020

(87) PCT Pub. No.: WO2020/176068

PCT Pub. Date: Sep. 3, 2020

(65) Prior Publication Data

US 2021/0373474 A1 Dec. 2, 2021

(51) Int. Cl.

| | |
|---|---|
| ***G03G 15/00*** | (2006.01) |
| ***G03G 15/01*** | (2006.01) |
| ***G03G 15/10*** | (2006.01) |

(52) U.S. Cl.
CPC ..... *G03G 15/50* (2013.01); *G03G 15/01* (2013.01); *G03G 15/10* (2013.01)

(58) Field of Classification Search
CPC ..... G03G 15/50; G03G 15/01; G03G 15/10; G03G 15/5058; G03G 15/5062
See application file for complete search history.

(56) References Cited

U.S. PATENT DOCUMENTS

| | | | | |
|---|---|---|---|---|
| 5,493,321 | A | 2/1996 | Zwadio | |
| 5,533,628 | A | 7/1996 | Tao | |
| 6,985,254 | B2 | 1/2006 | Allen et al. | |
| 7,755,817 | B2 | 7/2010 | Ho et al. | |
| 9,057,645 | B2 | 6/2015 | Holub | |
| 2017/0329268 | A1 | 11/2017 | Tzomik et al. | |
| 2017/0371262 | A1* | 12/2017 | Uchiyama | G03G 15/5058 |
| 2018/0239273 | A1* | 8/2018 | Nelson | G03G 15/10 |

FOREIGN PATENT DOCUMENTS

| | | |
|---|---|---|
| EP | 1351483 | 10/2003 |
| JP | 2000267517 | 9/2000 |
| JP | 2009010983 | 1/2009 |
| JP | 2010137474 | 6/2010 |
| WO | WO-2016091335 | 6/2016 |
| WO | WO-2018192658 | 10/2018 |

* cited by examiner

*Primary Examiner* — Sandra Brase
(74) *Attorney, Agent, or Firm* — HP Inc. Patent Department

(57) ABSTRACT

A method of calibrating a developer unit of a liquid electrophotographic printer, the method comprising: setting a developer roller voltage and iteratively printing a patch on a print medium using different electrode voltages until a hue of a patch printed using one of the electrode voltages is within a tolerance of a target hue; and setting an electrode voltage based on said one of the electrode voltages and iteratively printing a patch on a print medium using different developer roller voltages until a hue of a patch printed using one of the developer roller voltages is within the tolerance of the target hue.

13 Claims, 8 Drawing Sheets

HUE BASED COLOR CALIBRATION

BACKGROUND

Liquid electro-photographic (LEP) printing, sometimes also referred to as liquid electrostatic printing, uses liquid toner to form images on paper, foil, or another print medium. The liquid toner, which is also referred to as ink, includes particles dispersed in a carrier liquid. The particles have a color which corresponds to the process colors that are to be printed in accordance with a used color model.

BRIEF DESCRIPTION OF DRAWINGS

Non-limiting examples will now be described with reference to the accompanying drawings, in which.

DETAILED DESCRIPTION

Figure 1:
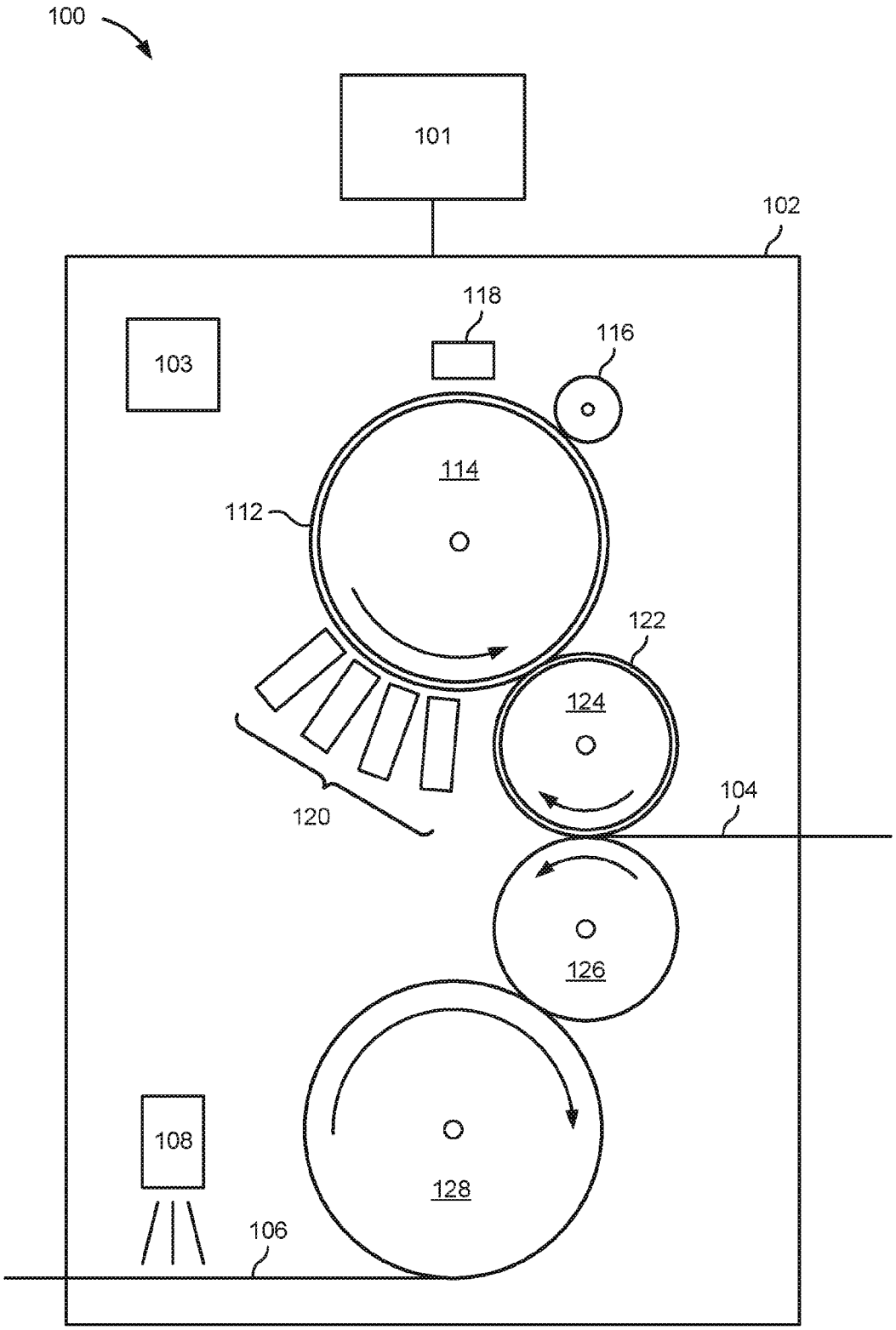
FIG. 1 illustrates a schematic diagram of a printing system, according to an example.

FIG. 1 illustrates an example of a printing system 100. In one example, the printing system 100 comprises an LEP printing system, such as an LEP printing press, and includes a user interface 101 that enables an operator to manage various aspects of printing, such as loading and reviewing print jobs, proofing and color matching print jobs, transferring approved print jobs to an approved print queue for printing, reviewing the order of the print jobs, handling media substrates, and so on. The user interface 101 may include a touch-sensitive display screen that allows the operator to interact with information on the screen, make entries on the screen, and generally control the printing system 100. A user interface 101 may also include other devices such as a key pad, a keyboard, a mouse, and a joystick, for example.

The printing system 100 includes a print engine 102 that receives a print medium/substrate 104 (hereinafter referred to simply as a print medium) from one or more media input mechanisms (not shown), and outputs a printed medium/substrate 106 (hereinafter referred to simply as a printed medium) to one or more media output mechanisms (not shown). Print medium 104 can be in various forms including cut-sheet paper from a stacked media input mechanism or a media web from a media paper roll input mechanism. In general, the print engine 102 generates printed medium 106 in the form of printed jobs and printed image patch sheets. In some examples printed jobs may be output to an output stacker tray while printed image patch sheets are output to a separate sample tray. When the printed medium 106 is a media web, one or more finishing devices may be employed to cut the printed media web into sheets prior to it being stacked in an output stacker tray. Alternatively, the printed media web may not be cut into sheets and stacked, but instead may be output to a media output roll.

As shown in FIG. 1, an example printing system 100 also includes a spectral measurement device 108 to measure the reflection of individual image patches printed onto a printed medium 106. A light source (not shown) may accompany the spectral measurement device 108 to provide light for reflecting off the printed medium 106. The spectral measurement device 108 can be implemented, for example, as a spectrometer, spectrophotometer, spectrograph, spectral analyzer, or other suitable device to measure a reflection spectrum from printed medium 106. For example, a spectral measurement device 108 such as a spectrophotometer operates to measure the intensity of radiation (i.e., light) reflecting off a printed medium 106 as a function of its wavelength or frequency. More specifically, the spectrophotometer quantitatively measures the amount or intensity of light reflecting off a printed medium 106 across a range of wavelengths and at certain wavelength intervals. The range of wavelengths measured can vary, but in one example the wavelengths measured make up colors of the visible spectrum within the range of 380 to 750 nanometers (nm). An example of an interval over which wavelengths are measured is 10 nm. Thus, the spectrophotometer 108 may measure the amount of light reflected off a printed medium 108 for wavelengths within a range of 380 and 750 nm, with reflection measurements being taken at 10 nm intervals within that range. The intensity of reflected light at each wavelength interval can be measured and quantified as the number of photons being detected per second (e.g., using a photodiode, charge coupled device, or other light sensor). This photon flux density is typically expressed as watts per meter squared.

The print engine 102 also includes a photo imaging component, such as a photo imaging plate (PIP) 112 mounted on a drum or imaging cylinder 114. The PIP 112 defines an outer surface of the imaging cylinder 114 on which images can be formed. Although in FIG. 1 the PIP 112 comprises a thin film of photoconductive material wrapped around a cylindrical surface of a rotating drum, the photo imaging component may be provided on a belt, band, web, or platen. A charging component such as charge roller 116 generates electrical charge that flows toward the surface of the PIP 112 and covers it with a uniform electrostatic charge. A laser imaging unit 118 exposes image areas on the PIP 112 by dissipating (neutralizing) the charge in those areas. Exposure of the PIP 112 creates a 'latent image' in the form of an invisible electrostatic charge pattern that replicates the image to be printed.

After the latent/electrostatic image is formed on the PIP 112, the image is developed by a developer roller of a BID unit 120 to form an ink image on the outer surface of the PIP 112. Each BID unit 122 develops a single ink color (i.e., a single color separation) of the image, and each developed color separation corresponds with one image impression. While four BID units 120 are shown, indicating a four color process (i.e., C, M, Y, and K), other printing system implementations may include additional BIDs 120 corresponding to additional colors. After a single color separation impression of an image is developed onto the PIP 112, it is electrically transferred from the PIP 112 to an image transfer blanket 122, which is electrically charged through an intermediate drum or transfer cylinder 124. The image transfer blanket 122 overlies, and is securely attached to, the outer surface of the transfer cylinder 124. The transfer cylinder 124 is configured to heat the image transfer blanket 122, which causes the liquid in the ink to evaporate and the solid particles to partially melt and blend together, forming a hot adhesive liquid plastic that can be transferred to a print medium 104. Although in the print engine 102 of FIG. 1 the image transfer blanket 122 is wrapped around the transfer cylinder 124, other configurations may be provided such as, for example, a belt, band, web, or platen.

In the case of a printing system 100 that uses a print medium 104 comprising cut-sheet paper from a stacked media input mechanism, a single color separation impression of an image is transferred from the image transfer blanket 122 to a sheet of the print medium 104 held by an impression cylinder 126. The above process of developing image impressions and transferring them to the sheet of print medium 104 is then repeated for each color separation of the image. The sheet of print medium 104 remains on the impression cylinder 126 until all the color separation impressions (e.g., C, M, Y, and K) in the image have been transferred to the sheet. After all the color impressions have been transferred to the sheet of print medium 104, the printed medium 106 sheet comprises the full image. The printed medium 106 sheet with the full image is then transported by various rollers 128 (of which one is shown) from the impression cylinder 126 to an output mechanism (not shown).

In the case of a printing system 100 that uses a print medium 104 comprising a media web from a media paper roll input mechanism (not shown), the different color separations (e.g., C, M, Y, and K) of an image are transferred together from the image transfer blanket 122 to the web of print medium 104. Thus, the full image is built up on the blanket 122 prior to being transferred to the print medium 104. Here, the imaging process involves transferring each color separation from the PIP 112 to the image transfer blanket 122 until all the color separations making up the full image are present on the transfer blanket 122. Once all the color separations forming the full image have been transferred onto the image transfer blanket 122, the inks for all the color separations are heated on the blanket 122, and the full image is transferred from the blanket 122 to the web of print medium 104. The printed media/substrate web with the full image is then transported by various rollers 128 to the output mechanism where it is typically cut and stacked, or rolled onto an output media roll.

A controller 103 controls the components of the print engine 102 during the process of generating printed media 106. For example, the controller 103 may control the voltages applied to components of the BID unit 120 as well as the operation of the spectral measurement device 108 in order to implement a hue based color calibration process. In one example, the hue based color calibration process comprises iteratively adjusting electrode and developer roller voltages based on hues of printed patches calculated from reflection spectra. This will be described in further detail below.

Figure 2:
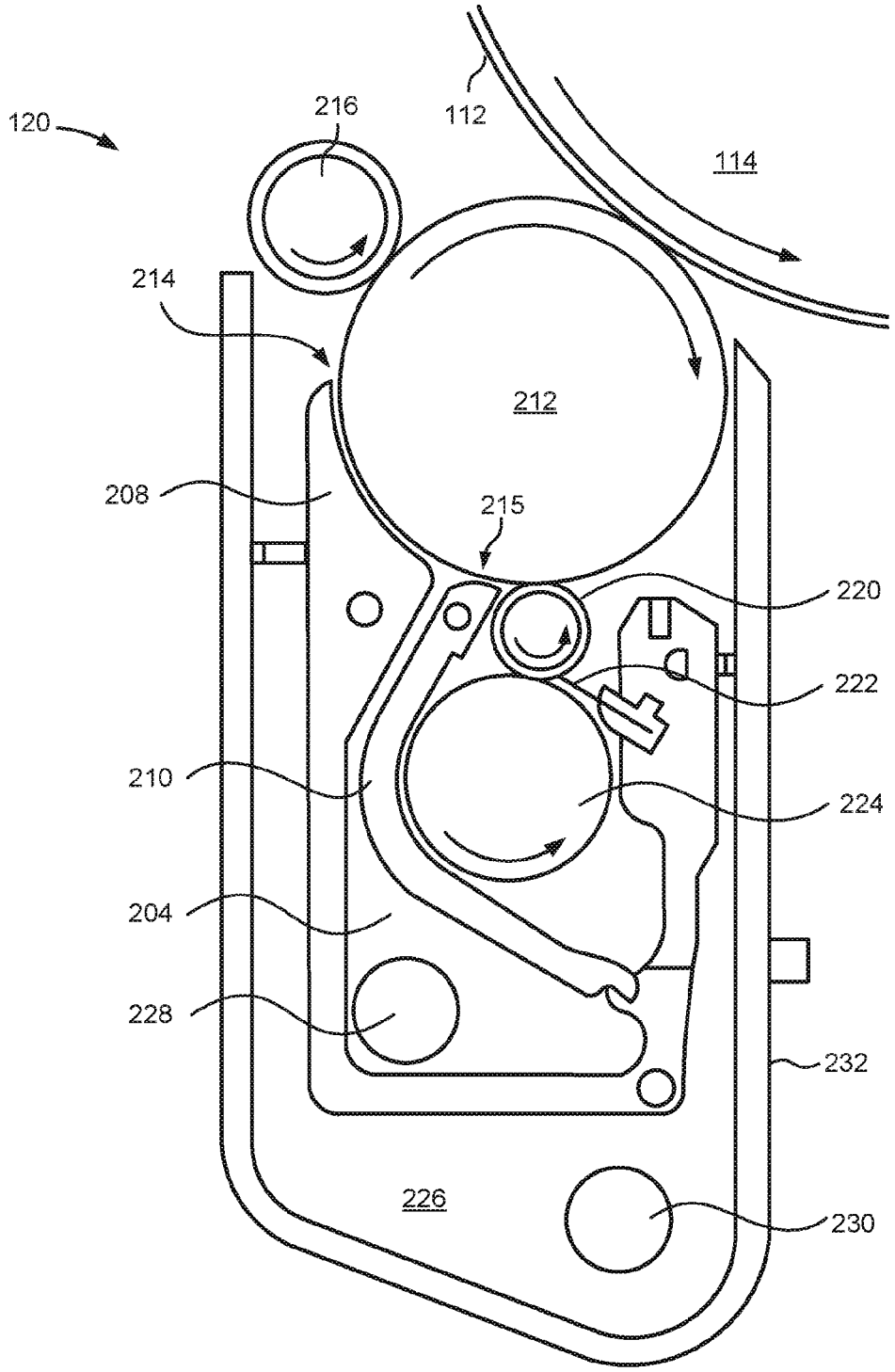
FIG. 2 is a schematic cross-sectional view of a binary ink developer (BID) unit of the printing system shown in FIG. 1, according to an example.

FIG. 2 is a cross-sectional diagram of an example of an ink development unit. In this example, the ink development unit is a binary image development (BID) unit 120 which may be included in the LEP printing system 100 shown in FIG. 1. The BID unit 120 comprises a developer roller 212 arranged to rotate about an axis fixed relative to a BID unit housing 232. The BID unit 120 may also comprise a number of other static parts and rollers which cooperate with the developer roller 212 to transport an amount of ink from the binary image development unit 212 to a photoreceptor (e.g., the PIP 112 shown in FIG. 1) on a photo imaging drum (e.g., the PIP 112 on the cylinder 114 shown in FIG. 1). As noted above, transfer members may take physical shapes other than cylindrical drums or rollers, the terms "drum" and "roller" may be understood to include alternative shapes of transfer member such as, for example, transfer belts and plates (curved or planar) etc.

In addition to the developer roller 212, the BID unit 120 includes a main electrode 208 and a back electrode 210 (simply referred to as electrodes), a squeegee roller 216, a cleaner roller 220, a wiper blade 222, a sponge roller 224, an ink chamber 204, an ink reservoir 226, an ink inlet 228, and an ink outlet 230. As noted above, a BID unit 120 as shown in FIG. 2 may be included within the LEP printing system 100 such as that shown in FIG. 1, and the LEP printing system 100 may include any number of BID units 120 as needed, each BID unit 120 containing a different color or type of ink with which to apply to the PIP 112.

To start developing ink, the BID unit 120 may be provided with a flow of ink pumped through the ink inlet 228 that allows a continuous supply of ink in the development area or zone, i.e., the gaps 214, 215 between developer roller 212 and electrodes 208, 210. The ink may be positively or negatively charged. For purposes of simplicity in illustration, the ink within the binary image development unit 120 in FIG. 2 is described as if it is negatively charged. As the ink is pumped into the ink chamber 204 via the ink inlet 228, two electrodes, main electrode 208 and back electrode 210, apply an electric field across respective gaps 214, 215. A first gap 214 is located between the main electrode 208 and the developer roller 212, and a second gap 215 is located between the back electrode 210 and the developer roller 212. The potential difference in electric charge across these gaps 214, 215 causes the ink particles to be attracted to the more positively charged developer roller 212. The applied voltage may be varied to increase or decrease the volume of ink drawn across the gaps onto the developer roll 212. For example, the electrical bias between the electrodes 208, 210 and the developer roller 212 may produce an electric field between the electrodes 208, 210 and the developer roller that is about 800-1000V. This causes negatively charged ink particles to be attracted to the developer roller 212.

The developer roller 212 may be made of a polyurethane material with an amount of conductive filler, for example, carbon black mixed into the material. This may give the developer roller 212 the ability to hold a specific charge having a higher or lower negative charge compared to the other rollers 114, 216, 220 with which the developer roller 212 directly interacts.

As the ink particles are built up on the developer roller 212, a squeegee roller 216 may be used to squeeze the top layer of oil away from the ink. The squeegee roller 216 may also develop some of the ink onto the developer roller 212. Thus, the squeegee roller 216 may be both more negatively charged relative to the developer roller 212. As the squeegee roller 216 comes in contact with the developer roller 212, the ink layer on the developer roller 212 may become more concentrated.

After the ink on the developer roller 212 has been further developed and concentrated by the squeegee roller 216, the ink may be transferred to the photoconductive PIP 112. For the purposes of simplicity in illustration, the PIP 112 is shown coupled to the photo imaging drum 114. However, the photo imaging drum 114 may incorporate the PIP 112 such that the photo imaging drum 114 and PIP 112 are a single piece of photoconductive material.

In one example, prior to transfer of ink from the developer roller 212 to the PIP 112, the PIP 112 or, alternatively, the PIP 112 and the photo imaging drum 114, may be negatively charged with a charge roller 116 (for example as shown in FIG. 1). A latent image may, therefore, be developed on the PIP 112 by selectively discharging selected portions of the PIP 112 with, for example, a laser such as laser imaging unit 118 shown in FIG. 1. The developer voltage is the voltage between the developer roller 212 and the PIP 112 after discharging by the laser imaging unit 118. The discharged area on PIP 112 may now be more positive as compared with developer roller 212, while the charged area of PIP 112 may still relatively be more negative as compared with developer roller 212. When the developer roller 212 comes in contact with the PIP 112 the negatively charged ink particles may be attracted to the discharged areas on the PIP 112 while being repelled from the still negatively charged portions thereon. This can create an image on the PIP 112 which may then be transferred to another intermediate transfer element (i.e. a blanket) or directly to a sheet or web of print media such as a piece of paper. Excess ink on the developer roller 212 may be removed using a cleaner roller 220 which may have a more positive bias compared to the developer roller 212. As such, the negatively charged ink particles may be attracted to the cleaner roller 220 and thereby removed from the developer roller 212. A wiper blade 222 and sponge roller 224 may subsequently remove the ink from the cleaner roller 220.

It will be apparent from the foregoing that the voltages applied to the electrodes 208, 210 and the rollers 212, 216, 220 of the BID unit 120, can affect the concentration, or thickness, of ink developed on the PIP 112 and, eventually, transferred onto the print medium 104. In examples described herein, electrode and developer roller voltages are calibrated based on hues of patches printed on a print medium.

Figure 3:
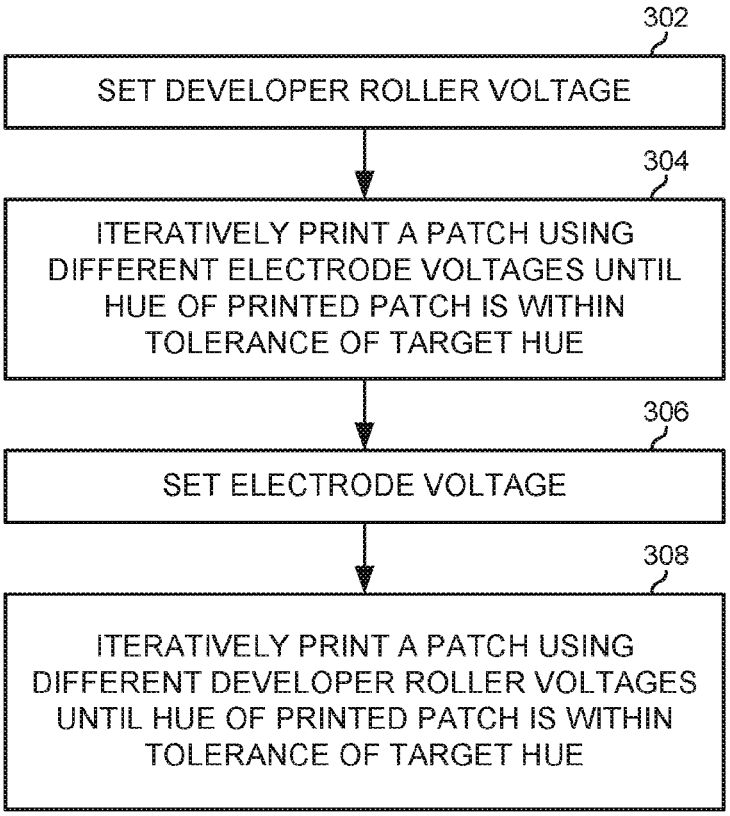
FIG. 3 is a flowchart of a hue based color calibration process, according to an example.

FIG. 3 is a flowchart of a calibration algorithm according to an example. Generally speaking, the algorithm can be divided into two stages: a first stage in which an electrode voltage is calibrated, and a second stage in which a developer roller voltage is calibrated. The first stage begins at block 302 in which a developer roller voltage is set. For example, the developer roller voltage may be set so that most of the ink charged by an electrode is developed on a PIP. At block 304 a patch is iteratively printed on a print medium using different electrode voltages until a hue of a printed patch is within a predetermined tolerance of a target hue. The second stage begins at block 306 in which a developer voltage is set. In one example, the developer voltage set at block 306 is based on the developer voltage obtained in the first stage. At block 308 a patch is iteratively printed on a print medium using different electrode voltages until the hue of a printed patch is within the predetermined tolerance of the target hue. The algorithm may be implemented by the controller 103 of the printing system 100 to calibrate the voltages of the electrodes 208, 210 and the developer roller 212 of the BID unit 120 illustrated in FIGS. 1 and 2. The electrodes 208, 210 may be charged to the same voltage so that the calibration of electrode voltage in block 304 may be performed for both electrodes 208, 210.

The calibration algorithm described above is based on the realization that the optical density (OD) of a printed ink layer is a less than ideal predictor for the thickness of the ink layer. This, in turn, may cause a large color error, specifically of the hue, with regard to target color coordinates, especially for chromatic colors aimed at increasing the color gamut, i.e., inks having a high chroma. One reason for the color mismatch is that the inherent tolerances of the OD are too large. Moreover, the higher the chroma of the color, the weaker is the dependence of the OD on the ink thickness.

Figure 4A:
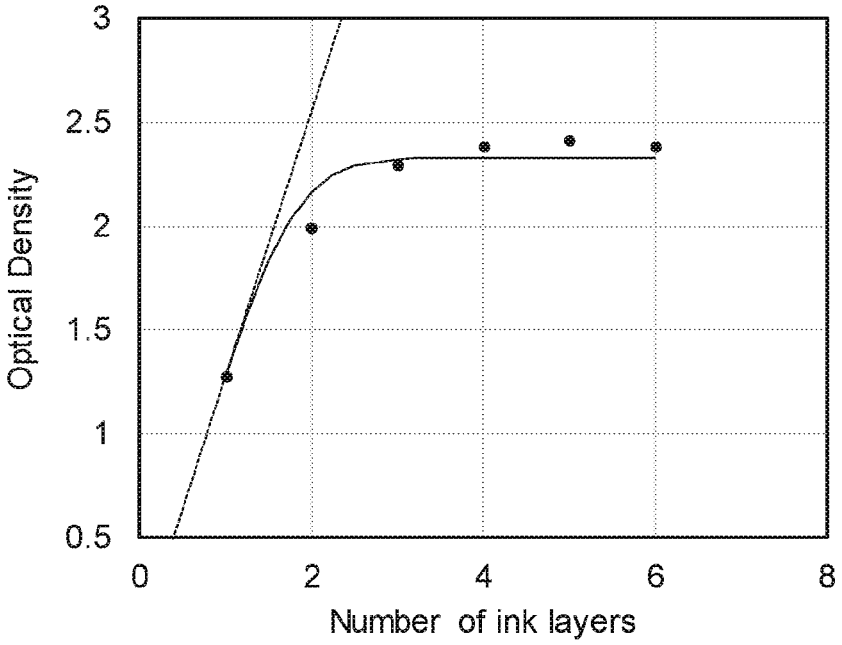
FIGS. 4A and 4B are graphs showing optical density as a function of number of ink layers and as a function of dry mass per area (DMA), respectively.
Figure 4B:
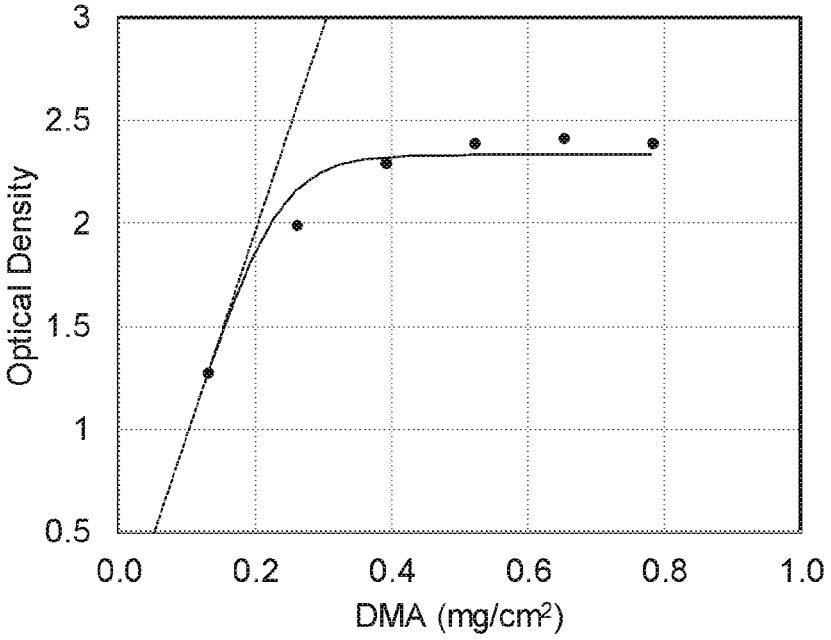

FIGS. 4A and 4B show experimental OD data of six different DMA points of high color gamut magenta ink were printed on top of each other and measured at a wavelength of 510 nm. For each layer, the dry mass per area (DMA) of the ink was measured so that the number of ink layers could be correlated to the DMA. Thus, the data shown in FIGS. 4A and 4B is the same except that FIG. 4A shows OD as a function of the number of ink layers whereas FIG. 4B shows OD as a function of the DMA. The Beer-Lambert law predicts that the OD is directly proportional (linear) to the layer thickness/DMA. However, as can be seen from FIGS. 4A and 4B, an increase in layer thickness, i.e., an increase in pigment loading, does not result in a good fit of the data using the Beer-Lambert law (dashed line). The OD saturates beyond a certain OD and deviates markedly from linear behavior. For example, if the calibration OD target is set, for example, to 2.3 it will not converge to that goal. Thus, for inks having a high chroma the dependence of OD on the layer thickness is extremely weak and is expected to be washed away by the OD tolerances. By way of comparison, a better prediction for the thickness of the ink layer can be obtained using the Kubelka-Munk model (solid line) which is a color mixing model that describes the reflectance and transmittance of a color sample with respect to the absorption and scattering spectra of the material. These results suggest that it is desirable to control the layer thickness directly based on the color of the layer.

Any suitable color space may be utilized in the color calibration algorithms described herein including, for example, the L*a*b* color space (also known as CIELAB) and the L*C*h° color space (also known as CIELCH). In the L*a*b* color space a* and b* represent color appearance, with red at positive a*, green at negative a*, yellow at positive b*, and blue at negative b*. L* indicates lightness and is perpendicular to a* and b* plane. The L*C*h* color space uses cylindrical coordinates instead of rectangular coordinates. L* is the lightness as with L*a*b*. h* is the hue, represented as an angle from 0° to 360° spanning color appearance. Hue angle starts at the +a* axis and is expressed in degrees, e.g., 0° is +a* (red), 90° is +b (yellow), 180° is −a* (green), and 270° is −b* (blue). The value of chroma C* is the distance from the centre of axes where L*=a*=b*=0 to the point under consideration in the a*, b* plane. Spectral measurement devices may calculate color coordinates of a color space from reflection spectra using standard procedures. The calculated color coordinates may then be compared to target color coordinates to determine a color difference. For example, a hue value calculated from a reflection spectrum may be compared to a target hue value in to determine the difference in hue Δh° between the printed sample and the L*C*h° color space. After identifying a color difference using the hue value, it is determined whether the measured hue is within a limit. In one example, a hue that falls inside the limit considered acceptable, while a hue that falls outside of the limit is rejected. Thus, a hue tolerance may define a range of hue values relative to a target hue in a color space.

Figure 5:
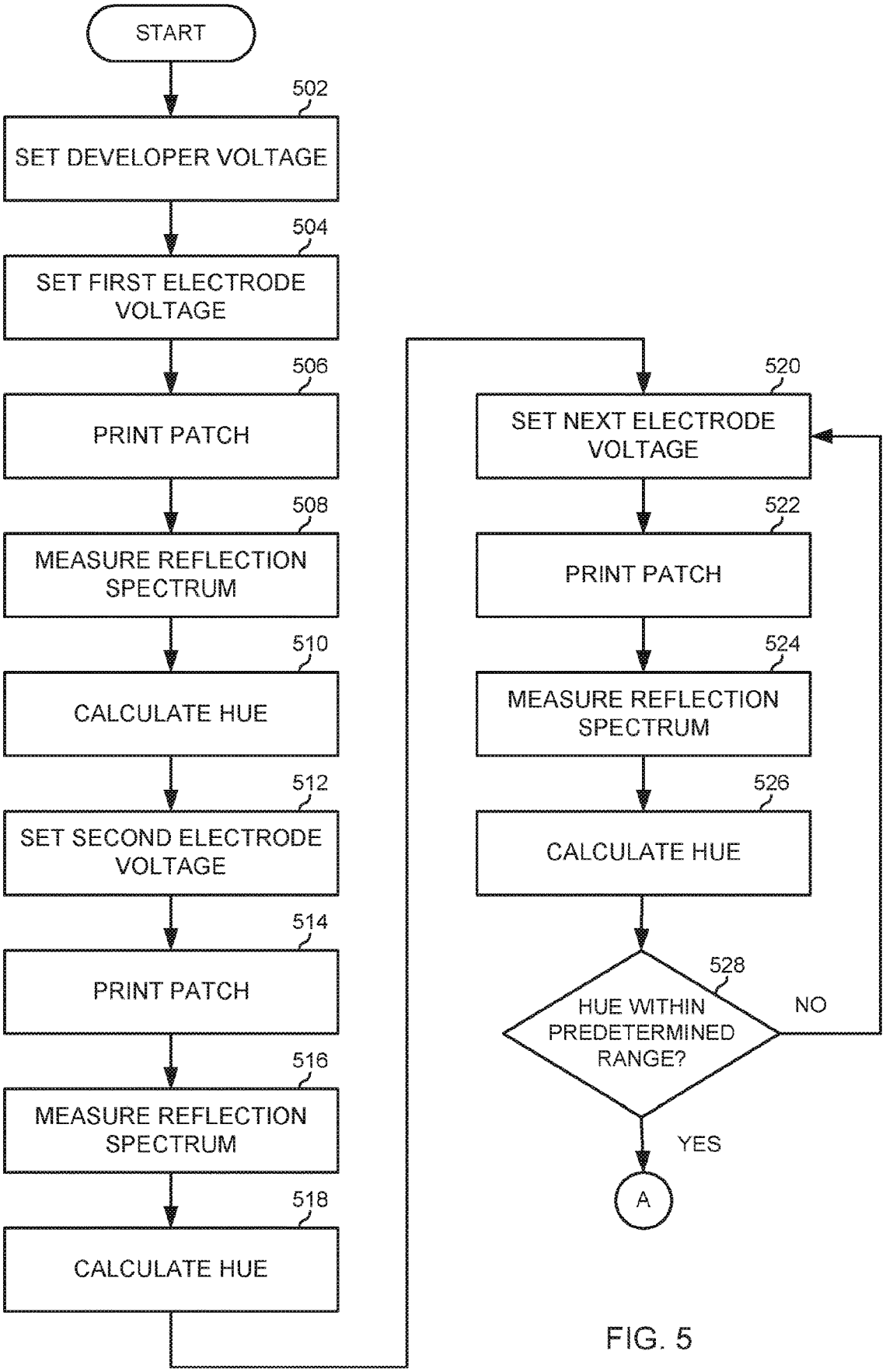
FIG. 5 is a flowchart of a process of calibrating an electrode voltage in the hue based color calibration process shown in FIG. 4, according to an example.

FIG. 5 is a flowchart showing part of an iterative color calibration algorithm in which electrode voltages are adjusted to obtain a patch having a hue that is within a tolerance of a target hue. As such, the process of FIG. 5 may correspond to blocks 302 and 304 of FIG. 3. The aim of the algorithm of FIG. 5 is to find, for a given developer roller voltage, a target electrode voltage that results in a target hue, Hue_target. The algorithm begins at block 502 in which the developer voltage is set. In one example, the developer voltage is set to a highest voltage that allows most of the ink charged by the electrode to go through to the PIP. In one example, the voltage is set to 600V. A first iteration begins at block 504 in which the electrode voltage is set to E_1. For example, the electrode voltage in the first iteration may be set to 1100V, a difference of 500V to that of the developer roller. At block 506 a patch is printed on a print medium. At block 508 a reflection spectrum is measured on the printed patch. For example, the reflection spectrum at block 508 may be measured by a device such as a spectral measurement device 108 of printing system 100 of FIG. 1. As noted earlier, a spectral measurement device may quantitatively measures the amount or intensity of light reflecting off a printed medium across a range of wavelengths and at certain wavelength intervals to obtain a reflection spectrum. At block 510 the hue of the printed patch is calculated as Hue_1 from the reflection spectrum. For example, color coordinates in a color space can be measured the reflection spectrum and this may be carried out in accordance with standard procedures.

A second iteration begins at block 512 where the electrode voltage is set to E_2. For example, the electrode voltage in the second iteration may be set to 1500V, a difference of 900V to that of the developer roller. It will be appreciated of course that the voltages in the first and second iterations may be swapped and that different voltages may be used. Blocks 514, 516, and 518 are similar to blocks 506, 508, and 510 and respectively comprise printing another patch on the print medium, measuring the reflection on the printed patch, and calculating the hue of the printed patch as Hue_2. At 520 the electrode voltage E_n for the next (third) iteration is set. In one example, the voltage is set according to the equation:

$$E_n=E_1+(E_2-E_1)*(H_\text{target}-\text{Hue}_1)/(\text{Hue}_2-\text{Hue}_1).$$

The electrode voltage E_3 for the third iteration will be between E_1 and E_2. As before, blocks 522, 524, and 526 are similar to blocks 506, 508, and 510 and result in a calculated hue, Hue_3, of a printed patch.

At block 528 it is determined whether Hue_3 is within a tolerance of Hue_target. If Hue_3 is within an allowed tolerance of Hue_target, the process continues to block 602 of FIG. 6. If Hue_3 is different from Hue_target by more than the allowed tolerance, the process returns to block 520 for another (fourth) iteration. In the fourth iteration, the equation to set the electrode voltage utilises E_3 and Hue_3 from the preceding (third) iteration, as well as either E_2 and Hue_2 or E_1 and Hue_1. Thus, in examples, the electrode voltage for the third and each subsequent iteration is within the electrode voltages of the two preceding iterations. That is to say, the electrode voltage E_3 of the third iteration will be between the electrode voltages E_1 and E_2 of the first and second iterations, the electrode voltage E_4 of the fourth iteration will be between the electrode voltage E_3 of the third iteration and one of the electrode voltages E_1 and E_2 of the first and second iterations (for example, the electrode voltage that is closest to the electrode voltage E_3), and so on. The corresponding hues will also be used. In this way, the iterative process starts from two electrode voltages that define a maximum electrode voltage and a minimum electrode voltage and converges towards an electrode voltage that results in a hue that is within a tolerance of a target hue.

Figure 6:
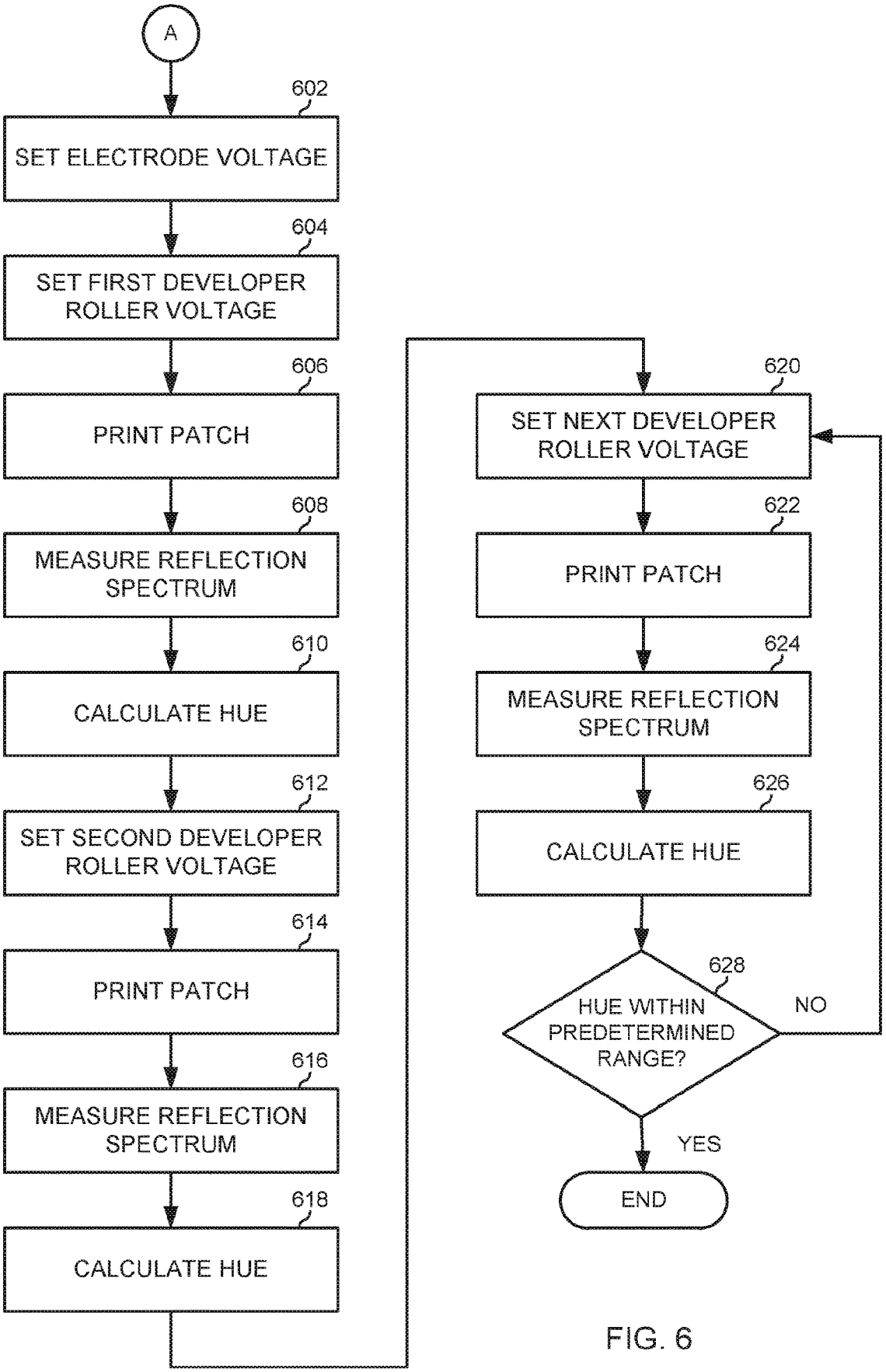
FIG. 6 is a flowchart of a process of calibrating a developer roller voltage in the hue based color calibration process shown in FIG. 4, according to an example.

FIG. 6 shows part of an iterative color calibration algorithm in which developer roller voltages are adjusted to obtain a patch having a hue that is within a tolerance of a target hue. In one example, the flowchart of FIG. 6 corresponds to blocks 306 and 308 of FIG. 3. Thus, in one example the algorithm of FIG. 6 follows on from the algorithm of FIG. 5.

The calibration algorithm of FIG. 6 aims to find a target developer roller voltage that provides a target hue, Hue_target. After electrode voltage E_n is established in 528 of FIG. 5, the electrode voltage is multiplied by an upscaling factor (a "partial ink development" PID factor), i.e., E_0=E_n*(1+PID). In one example, the PID factor increases the electrode by around 20%. Thus, if the electrode voltage E_n established at block 528 of FIG. 5 is 1000V, the electrode voltage E_0 is set to 1200V at block 602. The remaining algorithm of FIG. 6 generally has the same structure as that of FIG. 5.

A first iteration begins at block 604 in which a first developer roller voltage D_1 is set. In one example, the developer roller voltage is set to 600V. At block 606 a patch is printed on a print medium, and at block 608 a reflection spectrum of the printed patch is obtained. At block 610 a hue of the printed patch is calculated based on the measured reflection spectrum.

A second iteration begins at block 612 in which a second developer roller voltage D_2 is set. In one example, the developer roller voltage is set to 400V. Once again, a patch is printed at block 614, a reflection spectrum is measured at 616, and a hue of the printed patch is calculated based on the reflection spectrum measured at 616.

At 620 the developer roller voltage D_n for the next (third) iteration is set. In one example, it is set according to the equation:

$$D_n=D_2+(D_1-D_2)*(\text{Hue_target}-\text{Hue}_D2)/(\text{Hue}_D1-\text{Hue}_D2).$$

The developer roller voltage D_n for the third iteration will be between D_1 and D_2. As before, blocks 622, 624, and 626 are similar to blocks 606, 608, and 610 and result in a calculated hue, Hue_3, of a printed patch. At block 628 it is determined whether Hue_3 calculated at block 626 is within a tolerance of Hue_target which is the same target hue in the algorithm of FIG. 5. If Hue_3 is within an allowed tolerance of Hue_target, the process ends. If Hue_3 is different from Hue_target by more than the allowed tolerance, the process returns to block 620 for another (fourth) iteration of the developer roller calibration. Similar to the algorithm of FIG. 5, in the fourth iteration, the equation to set the developer roller voltage utilises D_3 and Hue_3 from the preceding (third) iteration, as well as either D_2 and Hue_2 or D_1 and Hue_1. Thus, in examples, the developer roller voltage for the third and each subsequent iteration is within the developer roller voltages of the two preceding iterations. That is to say, the developer roller voltage D_3 of the third iteration will be between the developer roller voltages D_1 and D_2 of the first and second iterations, the developer roller voltage D_4 of the fourth iteration will be between the developer roller voltage D_3 of the third iteration and one of the developer roller voltages D_1 and D_2 of the first and second iterations (for example, the developer roller voltage that is closest to the developer roller voltage D_3), and so on. The corresponding hues will also be used. In this way, the iterative process starts from two developer roller voltages that define a maximum developer roller voltage and a minimum developer roller voltage and converges towards a developer roller voltage that results in a hue that is within a tolerance of the target hue.

Figure 7:
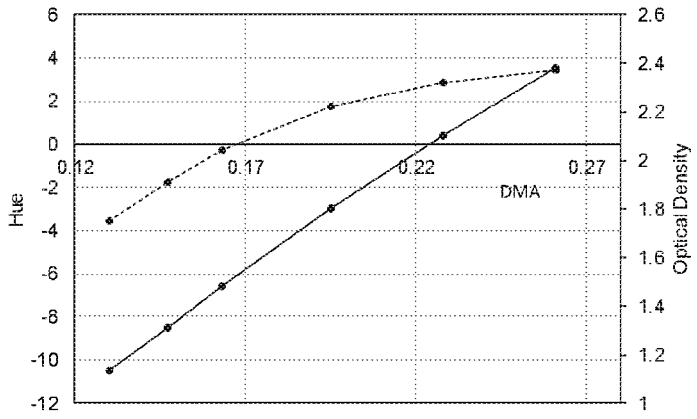
FIGS. 7, 8, and 9 are graphs showing hue and optical density as a function of DMA for magenta, cyan, and yellow inks, respectively.
Figure 8:
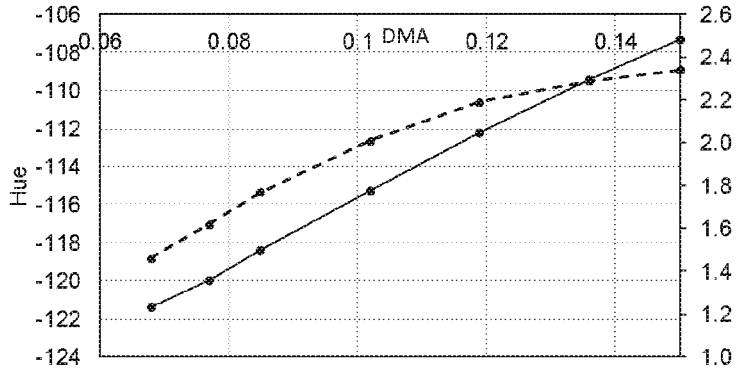
Figure 9:
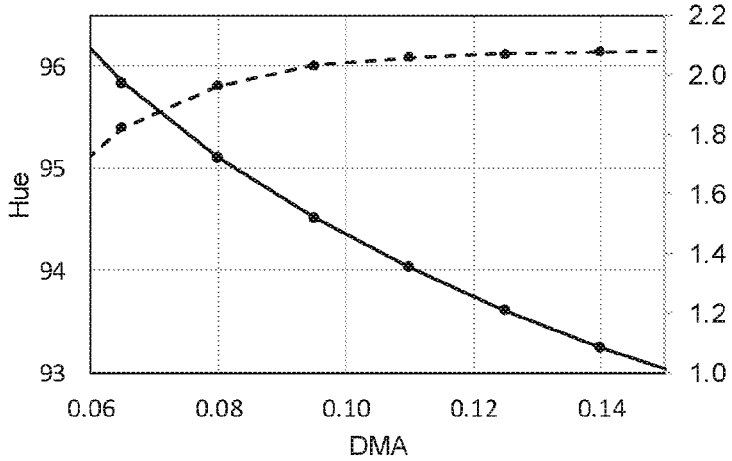

FIGS. 7-9 show experimental data of six different DMA points of high color gamut Magenta, Cyan, and Yellow ink. The graphs show hue and OD (both calculated using the Kubelka-Munk color model) as a function of DMA. In FIG. 7, the target hue of magenta for high color gamut ISO is −5°. In FIG. 8, the target hue of cyan for high color gamut ISO is −120°. In FIG. 9, the target hue of yellow for high color gamut ISO is 95°. As can be seen in these figures, the sensitivity (slope) of the hue as a function of DMA (represented by the solid line) is by far higher than that of the OD as a function of DMA (represented by the dashed line). In other words, these results confirm that the hue may be more sensitive than the OD for calibrating electrode and developer roller voltages. Calibration based on the hue may also provide one or more of improvement of color management and ink performance, tightened tolerances of the printed ink color coordinates, less print iterations of the color calibration, and fewer incidents of color calibration procedures not converging. Furthermore, hue is not affected by differences in the distance between the spectral measurement device and the print medium, or image wetness.

Figure 10:
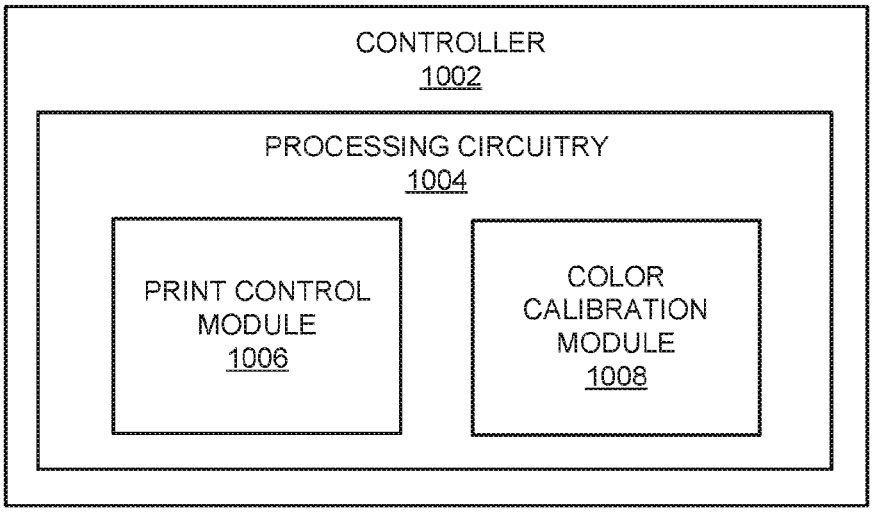
FIG. 10 schematically illustrates a controller to implement a hue based color calibration process, according to an example.

FIG. 10 is an example of an apparatus 1002 comprising processing circuitry 1004. In examples, the apparatus 1002 is implemented as the controller 103 of the printing system 100 shown in FIG. 1. In this example, the processing circuitry 1004 comprises a print control module 1006 and a color calibration module 1008. The print control module 1006 controls print operations such as, for example, setting electrode and developer roller voltages for printing a patch on a medium. The color calibration module 1008 receives reflection spectrum data of the patch obtained by a measurement device, such as measurement device 108 shown in FIG. 1, and calculates a hue of the patch. The color calibration module 1008 determines whether the hue of the patch is within a predetermined range. Data of the predetermined range may be stored in memory (not shown) which may be part of the controller 1002, e.g., part of the processing circuitry 1004, or may be separate from but accessible to the controller 1002. As such, the processing circuitry 1004 may carry out the method of FIG. 4. Each of the modules 1006, 1008 may be provided by a processor executing machine-readable instructions.

Figure 11:
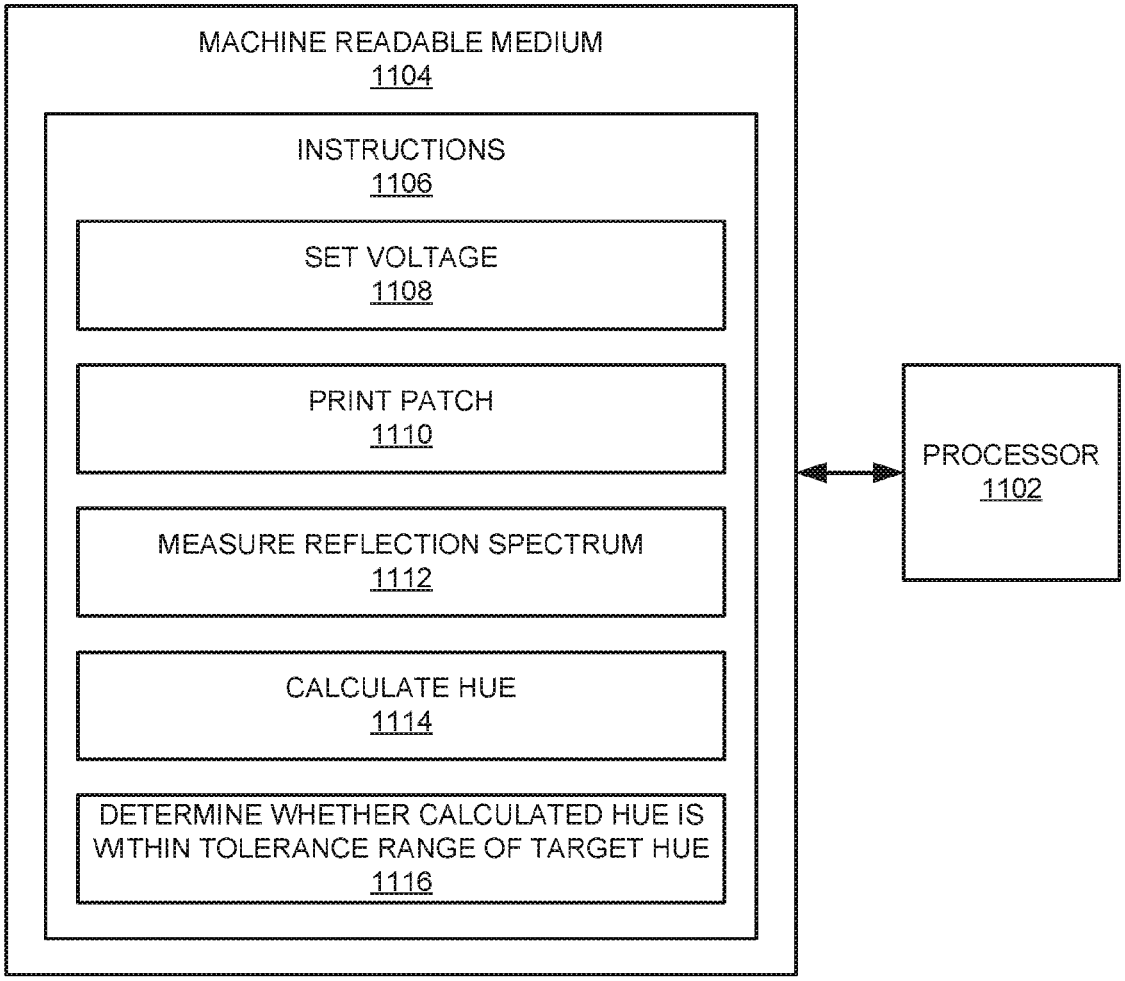
FIG. 11 schematically illustrates a machine readable medium associated with a processor, according to an example.

FIG. 11 is an example of a tangible, non-transitory, machine readable medium 1104 in association with a processor 1102. The machine readable medium 1104 stores instructions 1106 which may be non-transitory and which, when executed by the processor 1102, cause the processor 1102 to carry out processes. In this example, the instructions 1106 comprise instructions 1108 to seta voltage, instructions 1110 to print a patch on a print medium, instructions 1112 to measure a reflection spectrum from the patch, instructions 1114 to calculate a hue, and instructions 1116 to determine whether the hue is within a predetermined range. Such instructions may comprise algorithms to perform the iterations of the color calibration process described with reference to FIGS. 5 and 6.

In some examples, the instructions 1106 may comprise instructions to cause the processor 1102 to act as the modules of FIG. 10. For example, instructions 1108, 1110 may cause the processor 1102 to act as the print control module 1006 of FIG. 10 and instructions 1112, 1114, 1116 may cause the processor 1002 to act as the color calibration module 1008 of FIG. 10.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that various blocks in the flow charts and block diagrams, as well as combinations thereof, can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices (such as the print control module 1006 and the color calibration module 1008) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method of calibrating a developer unit of a liquid electrophotographic printer, the method comprising:

setting a developer roller voltage and iteratively printing a patch on a print medium using different electrode voltages until a hue of a patch printed using one of the electrode voltages is within a tolerance of a target hue; and setting an electrode voltage based on said one of the electrode voltages and iteratively printing a patch on a print medium using different developer roller voltages until a hue of a patch printed using one of the developer roller voltages is within the tolerance of the target hue.

2. The method according to claim 1, wherein the electrode voltages converge, starting from a first electrode voltage used in a first printing iteration and a second electrode voltage used in a second printing iteration.

3. The method according to claim 2, wherein the electrode voltages used in one or more further printing iterations after the first and second printing iterations are based on electrode voltages of preceding printing iterations.

4. The method according to claim 3, wherein the electrode voltages used in the one or more further printing iterations are further based on hues of printed patches obtained in the preceding printing iterations.

5. The method according to claim 1, wherein the developer roller voltages converge, starting from a first developer roller voltage used in a first printing iteration and a second developer roller voltage used in a second printing iteration.

6. The method according to claim 5, wherein the developer roller voltages used in one or more further printing iterations after the first and second printing iterations are calculated based on developer roller voltages of preceding printing iterations.

7. The method according to claim 6, wherein the developer roller voltages used in the one or more further printing iterations are further based on hues of printed patches obtained in the preceding printing iterations.

8. The method according to claim 1, wherein the setting of the electrode voltage comprises multiplying said one of the electrode voltages by an increase factor.

9. A calibration method for a binary ink developer unit of a liquid electrophotographic printer, the method comprising:

setting an initial developer roller voltage;

performing a first iterative process to determine a target electrode voltage that produces a printed patch with a target hue, wherein individual iterations of the first iterative process comprise:

setting an electrode voltage, printing a patch on a print medium using the electrode voltage set for the iteration and the initial developer roller voltage, and determining a hue of the patch printed using the electrode voltage set for the iteration and the initial developer roller voltage;

performing a second iterative process to determine a target developer roller voltage that produces a printed patch with the target hue, wherein individual iterations of the second iterative process comprise:

setting a developer roller voltage, printing a patch on the print medium using the developer roller voltage set for the iteration and an electrode voltage based on the target electrode voltage, determining the hue of the patch printed using the developer roller voltage set for the iteration and the electrode voltage based on the target electrode voltage.

10. The method according to claim 9, wherein determining the hue of the patch comprises measuring a reflection spectrum of the patch.

11. A liquid electrophotographic printing system comprising:

a developer roller;

an electrode to develop ink onto the developer roller using a potential difference between a voltage of the electrode and a voltage of the developer roller, wherein at least a portion of the ink is used to print a patch on a print medium;

a measurement device to measure a reflection spectrum of the patch;

a controller to:

calculate a hue of the patch based on the reflection spectrum;

control an iterative print and measure process in which hues of printed patches are used to calibrate the voltages of the electrode and the developer roller;

wherein the voltage of the electrode is changed in a first sequence of iteration and the voltage of the developer roller is changed in a second sequence of iterations.

12. A printing system according to claim 11, wherein the second sequence of iterations occurs after the first sequence of iterations.

13. A non-transitory machine-readable storage medium storing instructions, which when executed by a processor of a liquid electrophotographic printing system, cause the liquid electrophotographic printing system to set a developer roller voltage and iteratively printing a patch on a print medium using different electrode voltages until a hue of a patch printed using one of the electrode voltages is within a tolerance of a target hue; and set an electrode voltage based on said one of the electrode voltages and iteratively printing a patch on a print medium using different developer roller voltages until a hue of a patch printed using one of the developer roller voltages is within the tolerance of the target hue.

* * * * *